US005465778A

United States Patent [19]

Clark et al.

[11] Patent Number: 5,465,778

[45] Date of Patent: Nov. 14, 1995

[54] METHOD OF CASTING ONE PIECE CYLINDER LINER INCORPORATING A DRAFTLESS WATER JACKET

[75] Inventors: Richard J. Clark; Richard K. Clark, both of Gilman; Dennis E. Clark, Onarge, all of Ill.

[73] Assignee: Clark Industries, Inc., Gilman, Ill.

[21] Appl. No.: 275,507

[22] Filed: Jul. 15, 1994

Related U.S. Application Data

[62] Division of Ser. No. 29,625, Mar. 11, 1987, Pat. No. 5,337, 709.

[51] Int. Cl.[6] ..... B22D 33/04

[52] U.S. Cl. ..... 164/137; 164/340

[58] Field of Search ..... 164/137, 339, 164/340, 341

[56] References Cited

U.S. PATENT DOCUMENTS 4,757,857 7/1988 Henkel ..... 164/339

FOREIGN PATENT DOCUMENTS 2-15850 1/1990 Japan ..... 164/340

*Primary Examiner*—Mark Rosenbaum

*Assistant Examiner*—Randolph S. Herrick

*Attorney, Agent, or Firm*—Kajane McManus

[57] ABSTRACT

The unitary cylinder liner incorporating a water jacket is vertically cast as a one piece unit. The water jacket is draftless, allowing water to circulate therethrough more efficiently, increasing cooling capabilities. Such vertical one piece casting is made possible by the novel two piece core which eliminates the need for welding of metal bands onto an outer surface of the liner to produce the water jacket thereof. A novel method of vertical casting is also provided by use of the two piece core.

1 Claim, 6 Drawing Sheets

FIG. 7
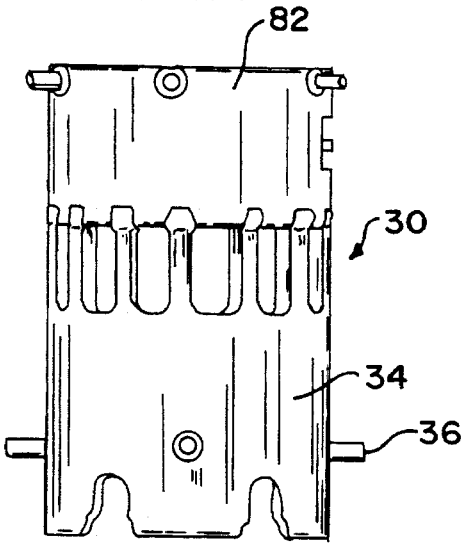
FIG. 8
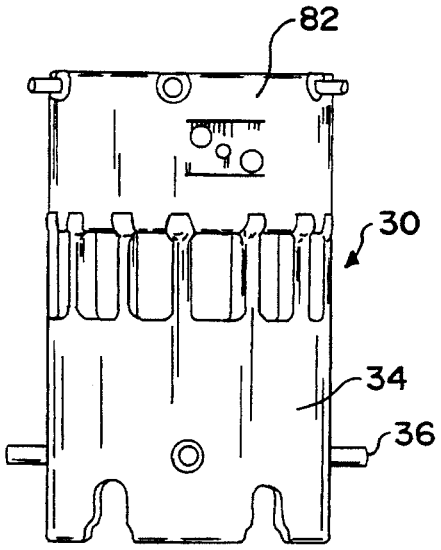
FIG. 9
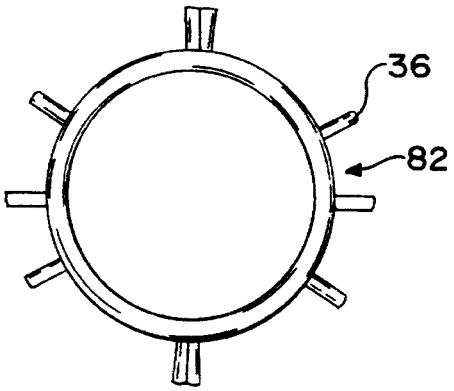
FIG. 10
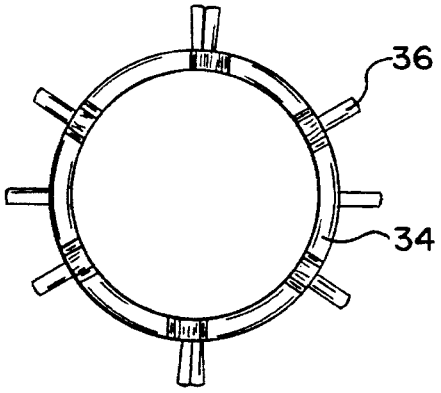
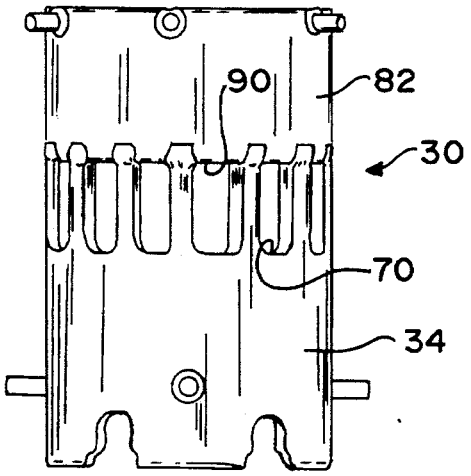
FIG. 11

FIG. 12
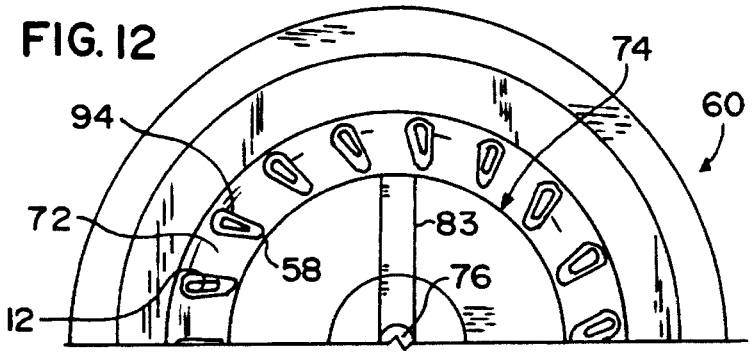
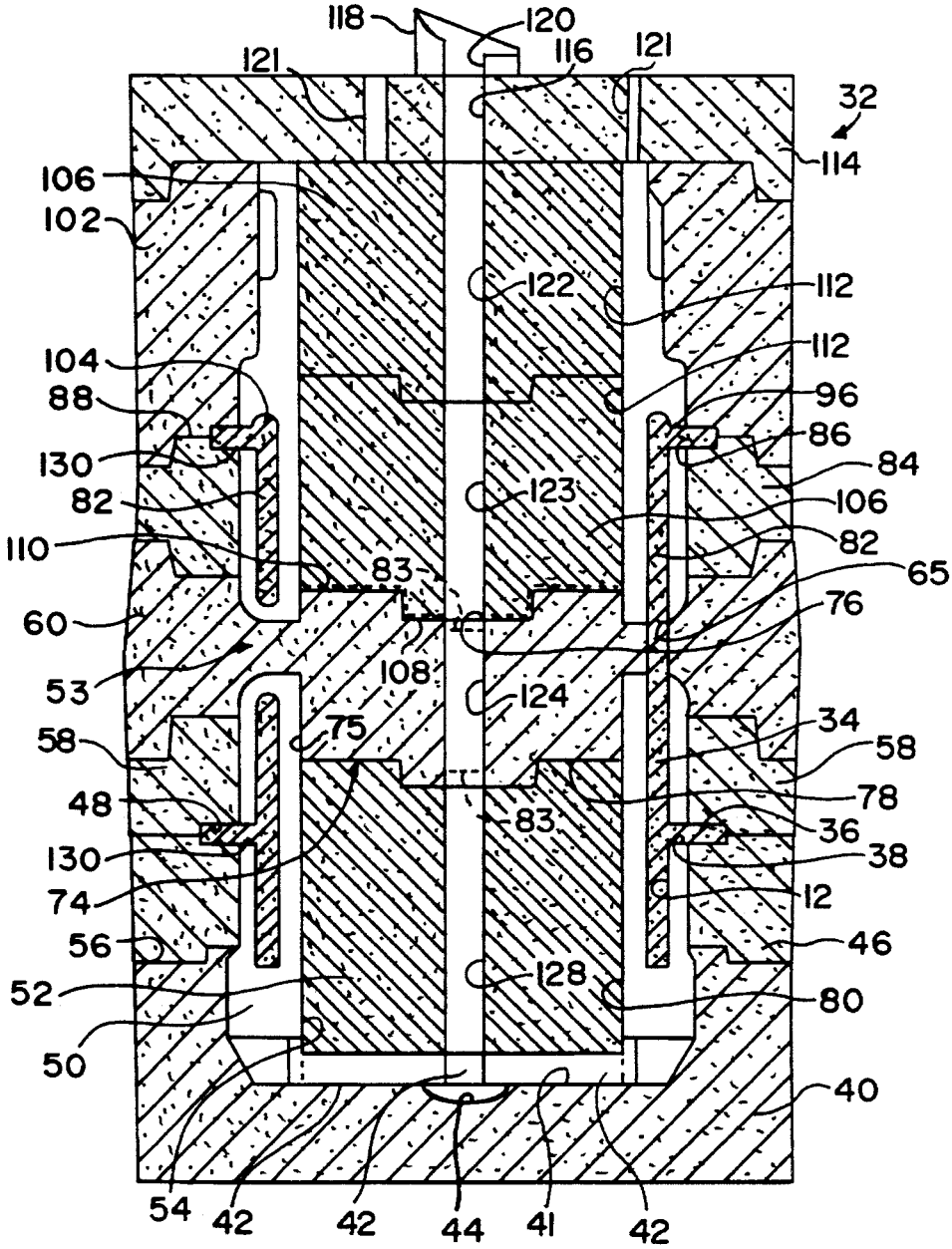
FIG. 13

METHOD OF CASTING ONE PIECE CYLINDER LINER INCORPORATING A DRAFTLESS WATER JACKET

CROSS REFERENCE TO RELATED APPLICATION

This application is a division of U.S. patent application Ser. No. 08/029,625 filed on Mar. 11, 1993 and entitled: One Piece Cylinder Liner Including a Draftless Water Jacket and Method for Making Same, and now U.S. Pat. No. 5,337,709.

FIELD OF THE INVENTION

The present invention pertains to a cylinder liner for an engine, the cylinder liner including a water jacket and being of unitary construction. More particularly the liner is a unitary, cast construction and includes a draftless water jacket. Such liner is created by use of a two piece core which allows the liner to be cast vertically, as one piece and without any drafts therein.

DESCRIPTION OF THE PRIOR ART

Heretofore the process for creating a cylinder liner incorporating a water jacket has been a very time consuming, imperfect process yielding a multiple piece unit having drafts in water passages thereof and requiring use of a core of many pieces to yield a liner to the outside of which bands must be welded to create an enclosed water jacket. Further, the casting of the liner has necessarily been horizontal, inherently yielding poor concentricity between the inside liner bore and the outside diameter.

As will be described in greater detail hereinafter, the disclosure herein provides a two piece core around which a one piece liner incorporating a draftless water jacket is vertically molded, creating a liner with an improved concentricity, larger airports and water paths which are straight, causing less water swirl and better cooling.

SUMMARY OF THE INVENTION

Accordingly it is a primary object of the invention to provide a one piece liner incorporating a water jacket.

It is a further object of the invention to provide a water jacket, the water paths of which are draftless.

It is still a further object of the invention to provide a simple two piece core about which the one piece liner may be cast.

It is yet a further object of the invention to provide a liner having improved concentricity between the inner liner bore and the outer diameter.

It is a further object of the invention to provide a method of vertically casting a one piece liner incorporating a water jacket.

These and other objects are met by the two piece core, the method, and the one piece liner formed thereby, all of which will be described in greater detail hereinafter.

BRIEF DESCRIPTION OF THE DRAWINGS

FIG. 7 is a side elevational view thereof;

FIG. 8 is a front elevation thereof;

FIG. 9 is a rear elevational view thereof;

FIG. 10 is a top plan view thereof;

FIG. 11 is a bottom plan view thereof;

FIG. 12 is a top plan view of a mold section used to create air ports in the liner.

FIG. 13 is a cross sectional view through a mold having the core therein.

DESCRIPTION OF THE PREFERRED EMBODIMENT

Figure 1:
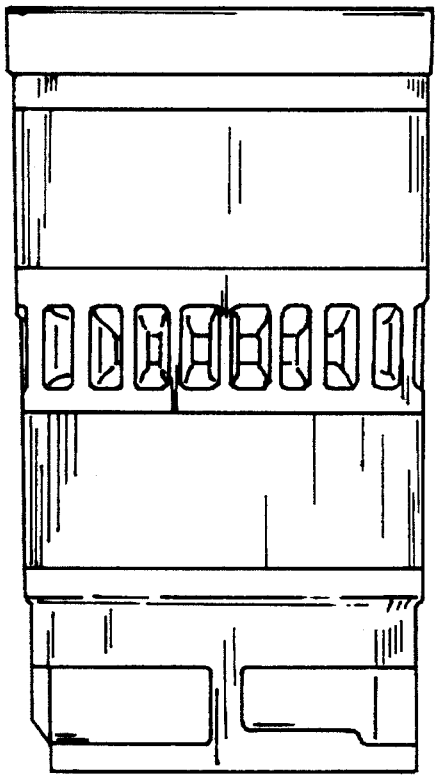
FIG. 1 PRIOR ART
FIG. 1 is a perspective view of a prior art liner.
Figure 2:
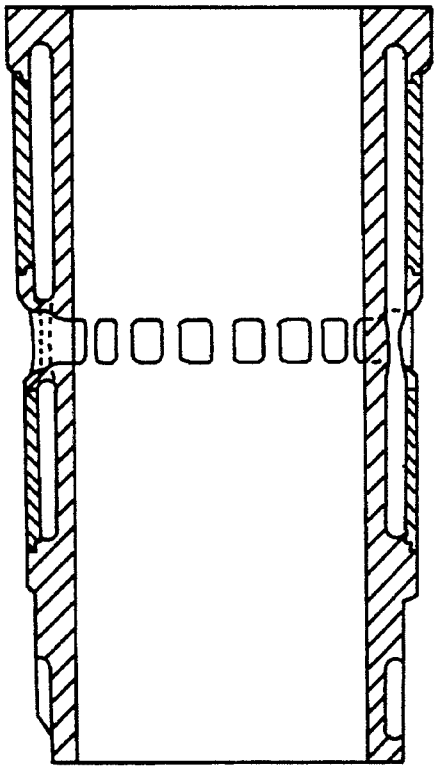
FIG. 2 is a cross sectional view through the prior art liner of FIG. 1.

Referring now to the drawings in greater detail, there is illustrated in FIGS. 1 and 2 a cylinder liner incorporating a water jacket made by present day horizontal casting methods using a core having many pieces. The first piece comprises a cast liner having an inner bore and water paths therethrough, the water paths lacking an exterior wall because of complex core design. The exterior surface of the liner is stepped so that a steel band may be slid over each of the upper and lower openings and welded thereover. Such construction leaves significant areas having a draft. These areas of draft inherently cause swirl of water passing thereacross, slowing water flow. Further, these areas cause a decrease in the size of the water path. Still further, if the bands are improperly welded into place, leakage can occur.

Figure 3:
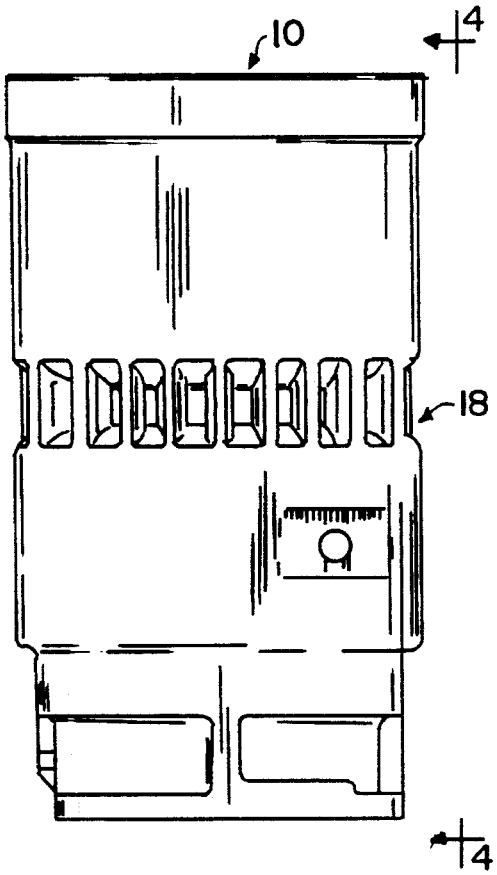
FIG. 3 is a perspective view of a one piece liner made in accordance with the teachings of the present invention.
Figure 4:
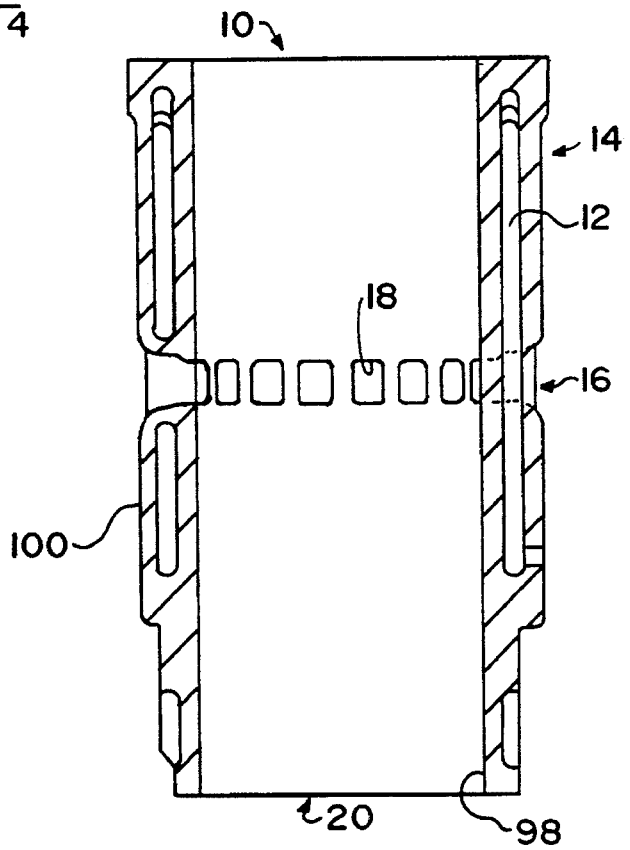
FIG. 4 is a cross sectional view through the liner of FIG. 3.

The cylinder liner 10 of the present invention shown in FIGS. 3 and 4 avoids all these shortcomings by being vertically cast as a unitary structure.

Figure 5:
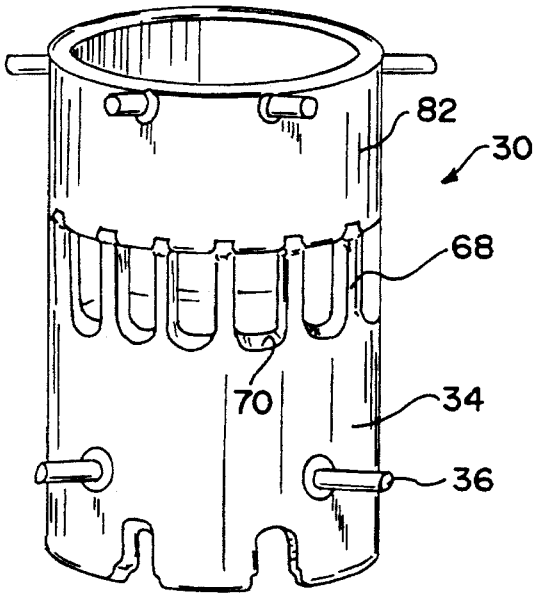
FIG. 5 is a perspective view of a two piece water jacket passage forming cylinder liner core made in accordance with the teachings of the present invention.
Figure 6:
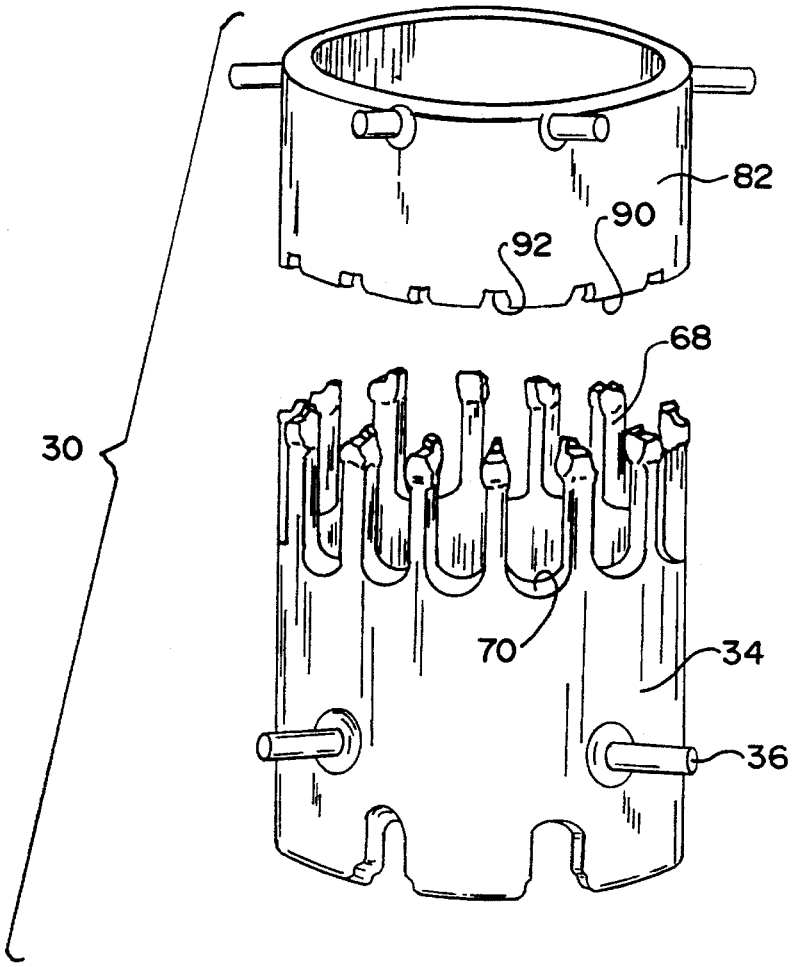
FIG. 6 is an exploded perspective thereof.
Figure 14:
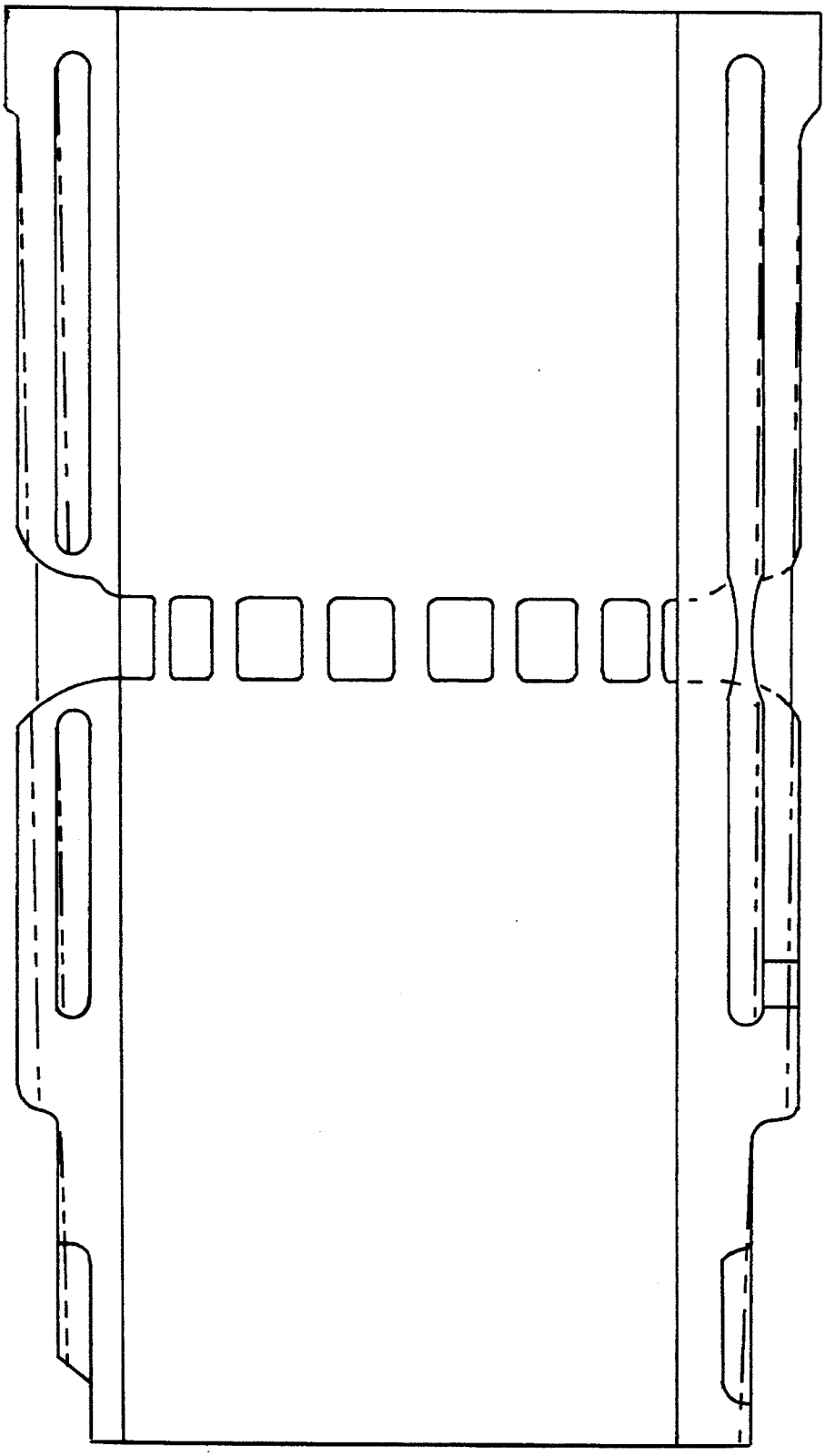
FIG. 14 is a cross sectional view through the liner of FIG. 3 showing drafts which have been eliminated therefrom in phantom.

First, the poor concentricity produced by prior art horizontal pouring is eliminated as will be described in greater detail in connection with the description of FIG. 5, et seq.

Secondly, all previously existing drafts are eliminated, as best shown in FIG. 4. In this respect, it will first of all be seen that water passages 12 in the water jacket portion 14 of the liner 10 are created without any drafts therein. This allows water to travel through these passages 12 much more quickly, significantly increasing the level of cooling.

Further, because a center area 16 of the liner 10 does not need to be undercut, air ports 18 produced by the present method can be significantly larger than those previously obtainable. Such larger air ports 18 provide for improved combustion of fuel in the smooth center bore 20 of the liner 10. Such improved combustion greatly increases fuel economy for any engine incorporating such a liner 10.

Further, labor in creating the liner 10 is significantly reduced because no welding is required. Also, the potential for leakage is virtually eliminated by eliminating the need for welding.

Still further, even though the air ports 18 have been increased in size, the water passages 12 extending therebetween have not been reduced in size, creating substantially straight passages 12 rather than passages which are reduced in diameter as they pass between the air ports 18.

All of the features are easily provided in the liner 10 of the present invention for two reasons. First, the liner 10 is vertically rather than horizontally cast. Second, such vertical casting is only possible because a simple two piece core 30 has been developed as shown in FIGS. 5–11 and 13.

It will first of all be understood that the two piece core 30 of the present invention is suspended within a mold 32 shown in FIG. 13, the core 30 being used to create the water passages 12 of the liner 10.

The two piece core 30 includes a substantially cylindrical bottom piece 34 which is suspended within the mold 32 at a predetermined position to form a lower section of the water passages 12. To be suspendable within the mold 32, a bottom piece 34 is provided with a plurality of radial fingers 36 which seat upon an upper surface 38 of an appropriate section of the mold 32.

It will be understood that the mold 32 is made up of several sections. The bottom or base section 40 includes a floor 41 into which a plurality of radial paths 42 extend outwardly from a center hollow 44 formed therein. Next follows a circular mold portion 46 which has undercut areas 48 in the surface 38 within which the core fingers 36 are accommodated, suspending the core bottom piece 34 a predetermined height above the floor 41 of the mold 32.

Such suspended positioning is necessary so that the molten material can flow below and around the core 30 to create a one piece liner 10 having a solid head portion 50. To create the smooth center bore 20 for the liner 10, a thick walled hollow cylinder shaped mold section 52 is then seated within a center hollow 54 in the core bottom piece 34. It will be seen that this section 52 rests on the bottom 41 of the mold base section 40, the radial paths 42 in the base section 40 providing a clearance thereunder from the center hollow 44. It will further be seen that a top surface 56 of the mold base section 40 is stepped inwardly upwardly. A further mold section 58 which is nearly identical to mold section 46 is then seated upon mold section 46.

Next a mold section 60 is set in place. Section 53 of mold section 60 is shown in FIG. 12 to be of a configuration which will form the throughbores [air passages] 18 through the thickness of the cast liner 10.

As stated above, the water passages 12 in the liner 10 extend upwardly through the circle of air ports 18, in the areas between adjacent ports 18. To produce these interposed water path sections 65 of the water passage 12, a plurality of towers 68 extend upwardly from an upper end edge 70 of the core bottom piece 34 and are located relative to one another in a manner in which each tower 68 rises up between adjacent spokes 72 on the mold section 60. If desired, one of the towers 68 may be provided with a unique tip configuration (not shown) to serve as a positioner for an upper piece 82 of the core 30 to be positioned thereover. The spokes 72 are centrally engaged to a thick walled, cylindrical hub 74 having a throughbore 76 centered therein. The hub 74 is radially outwardly stepped and has an outer surface 75 having a diameter equal to that of the thick walled mold section 52. When the mold section 60 seats over the mold section the hub 74 engages an upper surface 78 of the mold section 52 in a manner to provide a smooth continuation of the outer surface 80 of the mold section 52.

It will be seen that in the disclosed embodiment the spokes 72 are not truly radial, being slightly pitched therefrom. Such angulation is proposed to provide a greater surface area for the air ports 18, which also act as a heat sink, the increased surface area increasing cooling capacity. If desired, alignment slots 83 may be provided in the hub 74 which will coact with alignment ribs (not shown) in contiguous surfaces of the cylindrical members 52 and 106.

Next, a mold section 84 having a plurality of slots 86 in a top end edge 88 thereof is next positioned over the mold section 60, prior to placement of the core upper piece 82.

The core upper piece 82 is also a cylindrical piece 82. A bottom end edge 90 of the piece 82 has a plurality of short slots 92 therein which engage to and upon the tower 68 extending upwardly from the bottom piece 34, through open areas 94 between the spokes 72 on the mold section 60. If one of the towers 58 has been created with a unique locating configuration, then one of the slots 86 must be provided with a cooperating configuration.

The core upper piece 82 is also provided with a plurality of radial fingers 96 which coact with the slots 86 in the mold section 84, the fingers 96 positioning the core upper piece 82 again in a suspended manner in an engaged configuration relative to the towers 68 on the core bottom piece 34 to create a complete water path through the liner 10 between an inner wall 98 and an outer wall 100 thereof.

A further mold section 102 is positioned over the mold section 84, extending the mold 32 above the level of a top edge 104 of the core upper piece 82.

Two substantially identical mold sections 106 comprising a narrow thick walled hollow cylindrical member 106 are stacked within the core upper piece 82 and the mold piece 102. The mold sections 106 have a bottom wall 108 which is radially outwardly stepped, the bottom wall 108 of the lower section 106 nests within and against a coacting top surface 110 of the hub 74 of mold section 60. Lower mold section 106 may include an extra nub thereon which engages within alignment slot 83 if such slot 83 is in fact provided. An exterior surface 112 of these mold section 106 forms the final continuation of the smooth cylindrical mold surface created by the cylindrical member 52 and the hub 60 which will define the center bore 20 in the liner 10.

Finally, a mold top section 114 having a center pour port 116 therein is positioned appropriately and a pore trough 118 having a bore 120 therein which aligns with the pour port 116 is engaged. The top section 114 has a plurality of vent ports 121 therein as well.

Molten metal is then poured into the trough 118, flows down through aligned center bores 116, 122, 123, 124 and 128 of the mold sections 114, 106, 106, 60 and 52, respectively into the radial paths 42 and flows up and around the core 30, within the confines created by the plurality of mold sections.

Once the poured metal cools, the mold sections, being made of sand, are broken away revealing the one piece liner 10.

Ports 130 produced in the outer sidewall 100 of the liner 10 by the radial fingers 36 and 96 of the core pieces 34 and 82 serve as an outlet for the material of the core trapped within the casting. Once the core material has been eliminated from within the casting, the ports 130 may be plugged in any known, suitable manner to produce a smooth outer surface 100 to the one piece liner 10.

As described above, the liner 10, core 30 and method of the present invention provide a number of advantages, some of which have been described above and others of which are inherent in the invention. Also, modifications may be proposed to the liner 10, core 30 and method without departing from the teachings herein. Accordingly, the scope of the invention is only to be limited as necessitated by the accompanying claims.

We claim:

1. A method of vertically casting a one piece cylinder liner including a water jacket therein, the method comprising the steps of:

creating a mold base having a center hollow and a plurality of radial passages extending outwardly from said hollow;

creating a first thick walled cylindrical mold section which engages within said mold base and has a center bore therein which aligns with the center hollow of the mold base and setting the mold section within the mold base;

creating a first ring like mold section having slots on an upper surface thereof and engaging same upon an upper peripheral surface of said mold base;

creating a first cylindrical core piece having a predetermined diameter, the core piece having a plurality of radial fingers extending radially outwardly therefrom at a predetermined distance from a bottom edge thereof, said fingers being positioned to engage within the slots of the first ring like mold section and said core piece having a predetermined plurality of towers having a predetermined height extending upwardly from a top edge thereof;

engaging the core piece upon the first ring like mold section within the mold radially outwardly of the first thick walled cylindrical mold section;

creating a second ring like mold section which seats on said first ring like mold section and accommodates the radial fingers of said bottom core piece and engaging same upon an upper peripheral surface of said first ring like section;

creating a wheel like mold section having a cylindrical outer wall and a hub having outer cylindrical wall sections and opposed planar surfaces, each planar surface thereof being radially stepped about a center throughbore thereof and said hub outer cylindrical wall sections having an outer diameter equal to the outer diameter of said thick walled mold section, the outer wall of said wheel like mold section and said hub being joined to one another by a predetermined plurality of spokes, the spokes having separations therebetween sized and configured to allow the towers on said core bottom piece to pass therethrough;

engaging said wheel like mold section onto said second ring like mold section in a manner aligning said center throughbore thereof with said center throughbore of said thick walled mold section;

creating a third ring like mold section which engages upon said cylindrical outer wall of said wheel like mold section and having a plurality of slots at predetermined positions in an upper wall thereof, and setting the mold section on the wheel like mold section;

creating a second cylindrical core piece having a predetermined diameter which is equal to the diameter of said first core piece, the second core piece having a plurality of radial fingers extending radially outwardly therefrom at a predetermined distance from a top edge of the core piece, said fingers being positioned to engage within the slots in said third ring like mold section, and said core piece having a predetermined plurality of slots having a predetermined depth extending downwardly from a bottom edge thereof;

engaging the core piece upon the engaged third ring like mold section by engaging the radial fingers of the core piece within the mold section slots;

creating a fourth ring like mold section which seats on said third ring like mold section and also accommodates the radial fingers of said upper core piece with an undercut area provided in a bottom surface thereof;

creating substantially identical second and third vertically nesting thick walled cylindrical mold sections, a bottom one of which engages within said hub of said wheel like mold section, each section having a center bore therein which aligns with the center bore of the first cylindrical mold section and setting the second and third mold sections upon the hub of the wheel like mold section;

placing said fourth ring like mold section over said third ring like mold section;

creating a mold top section having a center opening therethrough which aligns with the center bore in said thick walled mold sections, an inner wall of all contiguous mold sections defining an outer wall of said liner and an outer surface of said thick walled mold sections and said hub defining a center bore of said liner, and said hub spokes defining air port openings extending through the entire thickness of said liner, and said towers defining paths extending between said air ports; and placing said top mold section and a pour trough over said fourth ring like mold section and pouring hot metal into the trough and created mold.

* * * * *